United States Patent [19]

Sato

[11] 4,276,828

[45] Jul. 7, 1981

[54] CONSTANT PRESSURE ASSEMBLY FOR HAND OPERATED LABEL PRINTING MACHINE

[75] Inventor: Yo Sato, Tokyo, Japan

[73] Assignee: Kabushiki Kaisha Sato Kenkyusho, Japan

[21] Appl. No.: 31,639

[22] Filed: Apr. 19, 1979

[30] Foreign Application Priority Data

Apr. 24, 1978 [JP] Japan ..... 53/47804

[51] Int. Cl.[3] ..... B41J 5/00

[52] U.S. Cl. ..... 101/291; 101/298; 101/288; 156/384

[58] Field of Search ..... 101/287, 288, 291, 292, 101/93.02, 316, 297, 298; 156/384

[56] References Cited

U.S. PATENT DOCUMENTS

| | | | |
|---|---|---|---|
| 4,206,704 | 6/1980 | Sato | 101/280 |
| 4,207,816 | 6/1980 | Sato | 101/288 |
| 4,208,964 | 6/1980 | Sato | 101/291 |

*Primary Examiner*—William Pieprz

*Attorney, Agent, or Firm*—Ostrolenk, Faber, Gerb & Soffen

[57] ABSTRACT

A hand operated label printing machine in which a series of labels are serially fed onto a printing platen in response to the squeezing of a hand lever so that they may be imprinted with selected indicia. The hand labeler is equipped with a constant pressure printing mechanism interposed between the hand lever and the frame of the hand labeler. That mechanism comprises a biased cam pivotally mounted to the hand lever and a roller on a biased support which support is pivotally mounted to the machine frame. The cam and roller are brought into abutment contact while the hand lever is being squeezed, and springs bias them into abutment and prevent their bypassage. The label printing force is the force that has to be applied for the cam to ride over the roller, which occurs when one of the springs resiliently deforms.

2 Claims, 4 Drawing Figures

L
E
19a
19b
26
27
28
A
30
33
32
5
21a
21
20
24
25
8
80
6
2
7
3
11
12
17
Lb
14
10
13
16
9
82
81
D
4
4a
1a
40a
B
40b
1
51
55
56
57
58
54
50
43
42
41b
41a
69b
69a
60
61
15a
15b
70
59
C
La
13a
18

CONSTANT PRESSURE ASSEMBLY FOR HAND OPERATED LABEL PRINTING MACHINE

BACKGROUND OF THE INVENTION

1. Field of the Invention

The present invention relates to a hand operated label printing machine or a hand labeler and particularly to a constant pressure printing mechanism and an ink supply mechanism for use with a hand labeler.

In a hand labeler, a series of pressure sensitive labels, which are temporarily adhered to a strip of carrier paper, are incrementally fed onto a printing platen in response to the squeezing of an actuating lever, so that the labels may be imprinted with selected indicia. The printed labels are peeled one by one from the carrier paper and are adhered to a commodity.

2. Description of the Prior Art

In one form of a conventional constant pressure printing mechanism for a hand labeler, a printing head is carried on the leading end of a printing lever, which may be integral with a hand operated lever, so that the printing head is moved together with the printing lever down toward the printing platen by the squeezing operation of the hand lever, thus printing the labels which have been fed onto the platen.

In such a conventional hand labeler, however, the printing pressure of the labels is directly dependent upon the strength and duration of the squeezing force that has been applied to the hand lever, with the resultant disadvantage that the density of the imprints differs among the labels in accordance with the intensity of the squeezing force.

To eliminate this problem, one constant pressure printing mechanism is shown in U.S. Pat. No. 3,911,817. In the constant pressure printing mechanism disclosed therein, a compression spring is interposed between the hand operated lever and the printing lever, which levers are made separate from each other rather than being integrated. An ink applying device, which is biased for rotation by a return spring, is provided at a front portion of the hand labeler and the ink applying device is urged into abutment contact with the types of the printing head. When the hand lever is squeezed, the aforementioned compression spring is compressed to store a compression force. When the stored compression force exceeds or overcomes the restraining limit of the return spring of the ink applying device, then the printing lever and the printing head are urged down to the platen, while also pushing away the ink applying device, by the force of the compression spring. Printing of the labels upon the platen is thus effected. As a result, the label printing is accomplished only by the stored force of the compression spring, irrespective of the intensity of the lever squeezing force, so that the printing operation can always be performed under a preset constant pressure. This has the advantage that the imprints on the labels can be less irregular.

In the above-described constant pressure printing mechanism, however, the printing is caused solely by the elastic force of the compression spring which is coactive with the printing lever. As the number of labels imprinted increases, the resultant printing pressure is reduced in proportion to the gradual weakening of the compression spring. Therefore, this conventional printing mechanism cannot be free from the disadvantage that the desired clear prints of the labels with preset density cannot be expected after many labels have been imprinted.

In other constant printing pressure mechanisms, it is known to have a pressure applying assembly on one relatively moving element of the hand labeler apply pressure to and eventually override a pressure receiving assembly on another relatively moving element of the hand labeler. This engagement between assemblies stops the hand operated lever or operating lever of the labeler from being operated to cause label imprinting until after a predetermined squeezing force is applied to the hand lever. Once the assemblies override each other, then the types on the printing head imprint a label with a constant printing pressure. Examples of this can be found in my copending applications, Ser. No. 866,991, filed Jan. 5, 1978 (now U.S. Pat. No. 4,207,816) and Ser. No. 909,431, filed May 25, 1978 (now U.S. Pat. No. 4,206,704). However, it is desired to make these assemblies simpler and more efficient than those in the above-mentioned applications.

Also in a hand labeler, inking of the types that imprint the label strips should be accomplished with a predetermined inking pressure, using inking rollers that follow a predetermined pathway across the faces of the types being inked, and wherein the mechanism by which the inking is accomplished operates efficiently and effectively and does not protrude so far beyond the front of the hand labeler as to interfere with a view of the label being applied by the hand labeler at the front of the body of the hand labeler. Various inking assemblies have been devised, including my own U.S. application Ser. No. 830,806, filed Sept. 6, 1977 (now U.S. Pat. No. 4,213,389). Again, however, the simplicity of the inking means for accomplishing the above noted purposes and further for assuring that the inking mechanism does not protrude in front of the labeler body is not as great as possible.

SUMMARY OF THE INVENTION

It is therefore an object of the present invention to provide a hand labeler which is free from the above-described drawbacks concomitant with the prior art.

Another object of the present invention is to provide a hand labeler which is equipped with a constant pressure printing mechanism, in which the printing operation can be accomplished under a preset constant pressure for a prolonged time period.

A further object of the invention is to enable constant pressure to be obtained in a labeler between the printing head carried on a printing lever, wherein the printing lever is integral with the hand lever of an operating lever, and a printing platen arranged to face the printing head.

Still another object of the present invention is to provide such a hand labeler which is of simple construction to reduce the production cost and which is also sufficiently durable.

A further object of the present invention is to provide a hand labeler, which is equipped with an ink supply mechanism of the dichroic type, for ensuring the uniform and smooth application of two different colors of ink to two rows of types of a printing device by the two inking rollers impregnated with two kinds of ink.

According to the present invention, a novel hand operated label printing machine is provided. The machine includes a frame and a grip lever integral with the machine frame. A hand lever is pivotally connected to the machine frame so that it may be manually squeezed toward and away from the grip lever. A printing lever is integral with the hand lever. There is a printing device which is carried on the printing lever and has types. A printing platen is connected to the machine frame and is positioned to face the printing device. Label feeding means feed a continuous strip of labels. The label strip is in the form of a series of pressure sensitive labels which are temporarily adhered to a strip of carrier paper. The label strip is fed onto the platen, whereon the labels in the strip can be imprinted by the types when the hand lever is squeezed toward the grip lever so that the printing device brings the types into abutment contact with the label strip that was fed onto the platen.

Printing pressure regulating means are interposed between the hand lever and the machine frame. They include a resiliently biased pressure applying assembly on one of the hand lever or the machine frame and a resiliently biased pressure receiving assembly which is made coactive with the pressure applying assembly located on the other one. The pressure applying assembly is brought into abutment contact with the pressure receiving assembly when the hand lever is being squeezed. The increasing squeezing force required to cause the former assembly to ride over the latter assembly, before the printing device abuts against said platen, establishes the printing force against the labels.

According to another feature of the present invention, the above-described hand operated label printing machine includes an ink supply device carrying an inking roller holder holding at least two inking rollers and made movable to bring the inking rollers into and out of contact with the types of the printing device so as to supply ink thereto. The ink supply device includes starting means which are coactive with the printing lever. The starting means engage a cam device that is linked to the inking roller holder, whereby movement of the printing lever moves the inking rollers over the types. Guide means regulate the movement of the two inking rollers along different loci.

BRIEF DESCRIPTION OF THE DRAWINGS

Other objects, advantages and features of the present invention will become apparent from the following description taken in connection with the accompanying drawings, in which.

DESCRIPTION OF THE PREFERRED EMBODIMENTS

Figure 1:
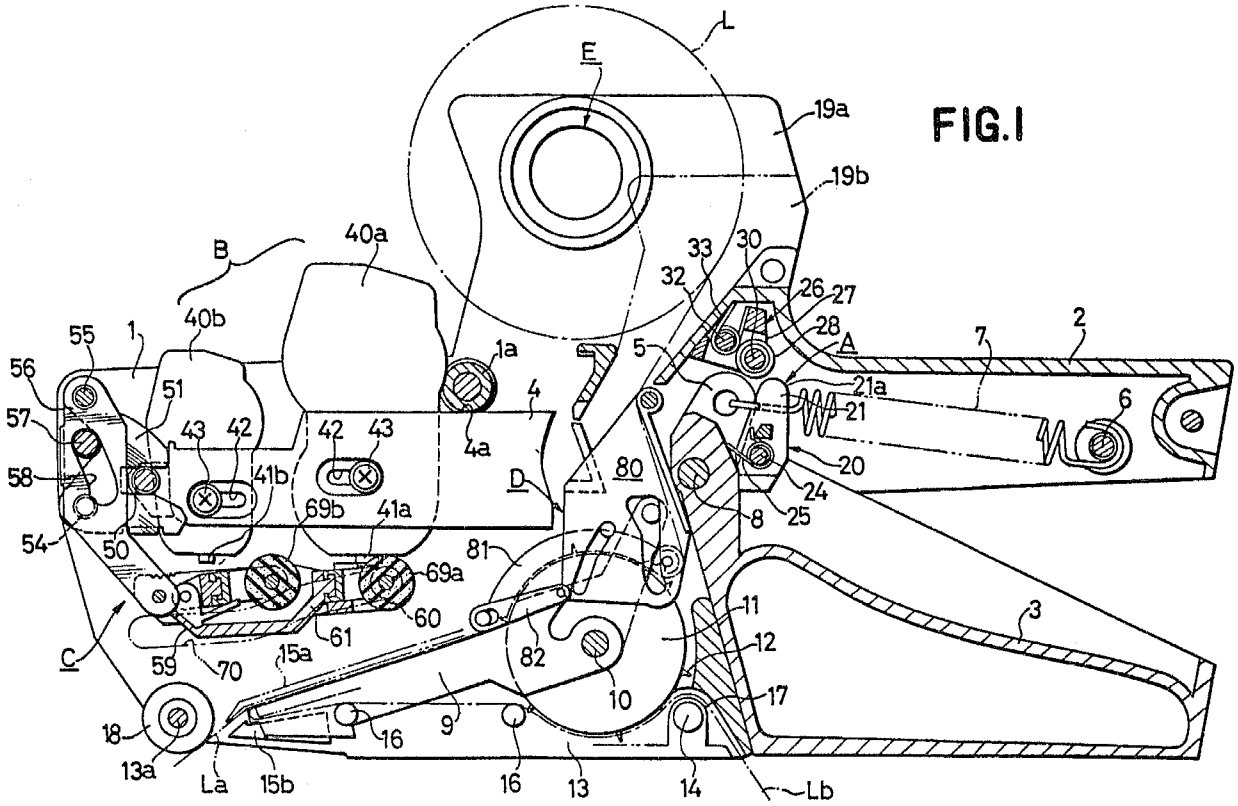
FIG. 1 is a partially sectional, side elevational view showing a hand labeler, which is equipped with both of a constant pressure printing mechanism and an ink supply mechanism according to the present invention, with the labeler frame on the viewing side removed.

Referring to FIG. 1, a hand operated label printing machine or a hand labeler exemplifying the features of the present invention includes a pair of longitudinally split grip levers 2 each of which is integral with and extends rearwardly (to the right) from a respective one of a pair of labeler frames 1, which are juxtaposed to each other at both sides of the labeler body. The grip levers 2 are fastened in registration with each other by means of pins (not shown). The labeler frames 1 are fastened to each other by various means, including a transverse pivot pin 8.

A hand lever 3 is pivotally mounted on the pin 8 so that the lever may be manually squeezed to and released away from the grip levers 2. The leading (left hand) end of the hand lever 3 is bifurcated to form a pair of printing levers 4, which carry two printing heads **40*a* and 40*b* of a printing device B. The printing heads 40*a* and 40*b* both carry imprinting types and the respective desired types 41*a* and 41*b* can be exposed downwardly. The printing heads 40*a* and 40*b* are fixed by means of fastening screws 43 in the longitudinal slots 42 which are formed in the printing levers 4 such that the longitudinal positions and relative spacing of heads 40*a*, 40*b*** can be adjusted.

A return spring 7 is mounted under tension between a spring holding portion 5 that extends integrally from the hand lever 3 and a spring holding pin 6 that is fixed to the inside walls of the grip levers 2. The return spring 7 continuously biases both the hand lever 3 and the printing levers 4 to rotate clockwise about the pivot pin 8 until they reach their rest positions, where the contact surfaces **4*a* of the printing levers 4 abut the pressure receiving portion 1*a* of the labeler frames 1**.

At the positions to which the types **41*a* and 41*b* can be lowered, there is a platen 9, which is rotatably mounted on the main shaft 10 of a rotatable feed roller 11. The platen 9 is fixed in position by closing a bottom cover 13. The cover 13 and the platen 9 are so constructed that they can be pivoted when a continuous strip of labels L is threaded to prepare for the label printing operation. The bottom cover 13 is pivotally connected to the shaft 13*a* which is located at the leading (left hand) end of the labeler frame 1. When a locking mechanism 14 is released, the bottom cover 13 can be turned clockwise about the shaft 13*a* downwardly to the outside. This frees the platen 9 to be turned counterclockwise about the main shaft 10, downwardly to the outside. Then, the label threading mechanism D comprised of a label starting member 80, a label holding member 81 and a label holding ring 82, all of which are made coactive with the platen 9**, is actuated to ensure the smooth threading of the label strip L. See, for instance, U.S. application Ser. No. 837,193, filed Sept. 28, 1977.

Above the leading (left hand) end portion of the platen 9, there is affixed a pair of label holding members **15*a*, which project from the inner walls of the labeler frames 1. Below the leading end portion of the platen 9, there is a carrier paper or backing strip holding member 15*b*, which is mounted on the upper side of the bottom cover 13 so as to hold the carrier paper Lb that has been peeled from the label strip L. As a result, there is defined a reversing direction, thin passage for the label strip L and the carrier paper Lb between the label holding members 15*a* and platen 9 and then between the platen 9 and the carrier paper holding member 15*b*. In addition, the bottom cover 13 carries guide rollers 16 and 17** for directing carrier paper out the bottom of the labeler.

There is mounted rotatably on the shaft **13*a* a label applying roller 18 which can apply individual labels in a series of labels A to a commodity as they are separated from the carrier paper Lb when the carrier paper Lb direction of travel is reversed in the vicinity of the leading end of the platen 9**.

The trailing end of the label strip L is dispensed from a label supply roller E which is rotatably mounted on a roller holding bracket 19*a* that is located above the labeler frames 1. There is also located at this side of FIG. 1 a shorter roller holding bracket 19*b* which is juxtaposed to the longer bracket 19*a* so as to prevent the label strip L from being loosened or let off to this side while it is being unrolled.

In operation, the label strip L is advanced in increments of one label length through the passage between the feed roller 11 and the label holding member 81 of the label threading mechanism D onto the platen 9. Meanwhile, the label strip L is being drawn by the feed roller 11, which is intermittently turned through a drive mechanism (not shown) in response to the releasing of the hand lever 3 after it has been manually squeezed. See, for example, U.S. application Ser. No. 864,096, filed Dec. 23, 1977. For this feeding purpose, the label strip L is formed with a series of engagement slits which are spaced apart a distance equal to the length of the labels La so that they may be engaged by the feed pawls 12 that are formed equidistantly apart upon the outer 12 that are formed equidistantly apart upon the outer circumference of the feed roller 11. As a result, the label strip L can be advanced upon the platen 9.

Figure 2:
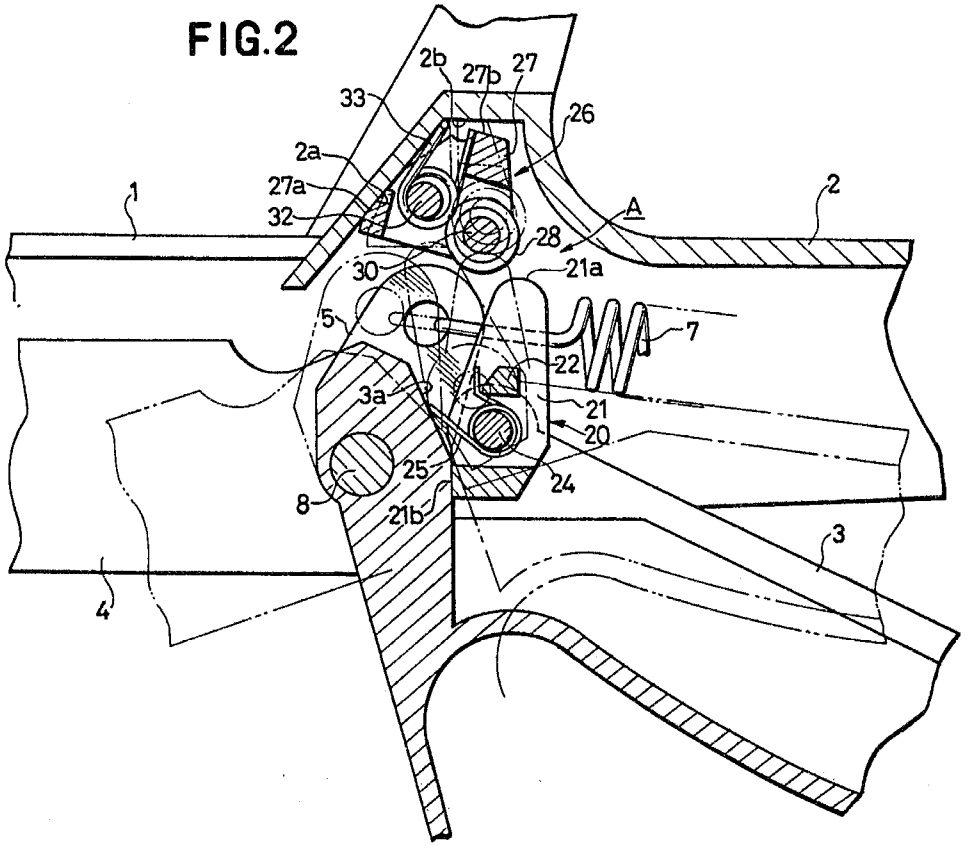
FIG. 2 is a longitudinal sectional view of a fragment of FIG. 1, showing the constant pressure printing mechanism of FIG. 1.
Figure 3:
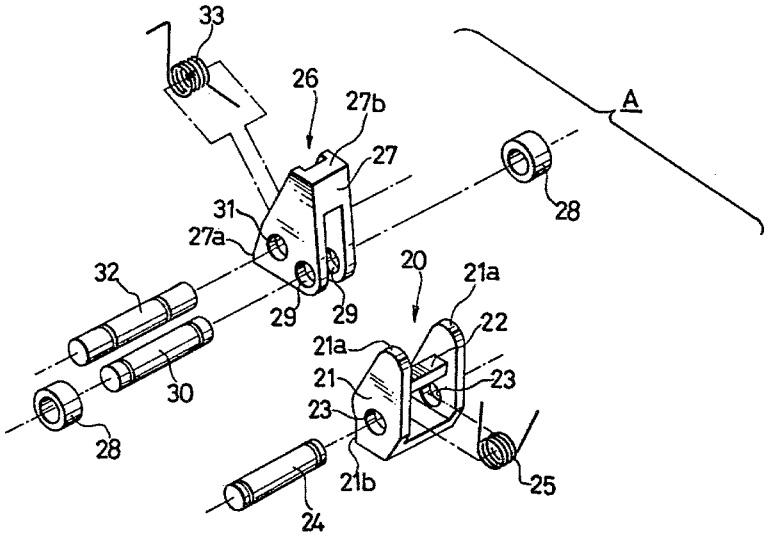
FIG. 3 is an exploded perspective view of the constant pressure printing mechanism of FIGS. 1 and 2.

A constant pressure printing mechanism A according to the present invention is now described. The constant pressure printing mechanism A ensures that the labels La of the label strip L are printed under a constant printing pressure with the indicia on the types 41*a* and 41*b* of the printing heads 40*a* and 40*b* of the printing device B. As better seen in FIGS. 2 and 3, the constant pressure printing mechanism A is principally comprised of a pressure applying assembly 20 and a pressure receiving assembly 26.

The pressure applying assembly 20 is positioned in the vicinity of the pivot pin 8 of the hand lever 3 and includes a pair of upright pressure cams 21, a cam shaft 25 and a torison spring 25. The pressure cams 21 are correspondingly shaped, upstanding and spaced apart. They are made of a synthetic resin having resiliency. They are formed at their head portions with resiliently yieldably cam surfaces 21*a*. At the same forwardly facing side of their leg portios the cams have respective contact surfaces 21*b*. The leg portions of the pressure cams 21 together define an aligned pair of shaft holes 23, in which the cam shaft 24 is inserted. The spring 25 is mounted on the shaft 24. Both ends of the cam shaft 24 are fixed to the side walls of the hand lever 3 by means of snap rings (not shown). The torsion spring 25 has one end that is held on or abuts against a spring holding portion 22 of the pressure cam 21 and has its other end held likewise on a pressure receiving surface 3*a* of the hand lever 3. As a result, the pressure cams 21 are always biased to rotate clockwise about the cam shaft 24 until they assume their upright positions, where their contact surfaces 21*b* abut against the pressure receiving surface 3*a* of the hand lever 3.

The pressure receiving assembly 26 is arranged closed to the leg portions of the grips levers 2. The pressure receiving assembly 26 is comprised of a pair of downwardly directed pressure receiving cams 27, a pair of pressure receiving rollers 28, a cam shaft 32 and a torsion spring 33. The pressure receiving cams 27 may also be made of a synthetic resin having resiliency. The two cams 27 are correspondingly shaped, upstanding and spaced apart, but closer together than cams 21. The cams 27 are each formed at their lower portions with a respective pair of shaft holes 29 and 31. The roller shaft 30 is fitted in the shaft holes 29 and it is fixed in the pressure receiving cams 27 by means of snap rings (not shown). The roller shaft 30 rotatably bears the paired pressure receiving rollers 28 at its both ends. The pair of pressure receiving rollers 28 are arranged outside of the pressure receiving cams 27 and are so placed and spaced that each roller 28 can be moved into abutment engagement with a respective cam surface 21*a* of a pressure cam 21. The cam shaft 32 is fitted in the other pair of aligned shaft holes 31. The cam shaft 32 is fixed to the grip levers 2 of the labeler frames 1 by means of snap rings (not shown).

The torsion spring 33 is mounted at the center portion of the cam shaft 32. The torsion spring 33 has one end that is held on or abuts against the pressure receiving cams 27 and has its other end held on the pressure receiving surface 2*a* of the grip levers 2. As a result, the pressure receiving cams 27 are also always biased to rotate clockwise about the cam shaft 32 by the action of the torsion spring 33 until they assume their lowered positions, where their pressure applying surfaces 27*a* abut against the pressure receiving surface 2*a* of the grip levers 2.

The operation of the constant pressure printing mechanism A is not described. In the rest position, the hand lever 3 is manually squeezed toward the grip levers 2 against the biasing force of the return spring 7. This turns the printing levers 4 downward, i.e. counter-clockwise, about the pivot pin 8 to carry the printing heads 40*a* and 40*b* toward the platen 9 until the types 41*a* and 41*b* abut against the inking rollers 69*a* and 69*b* of different colors of an ink supply mechanism C, which are described later in more detail. As a result, the dichroic inking rollers 69*a* and 69*b* are made to roll over the types 41*a* and 41*b*, respectively, while the inking rollers are regulated by a link mechanism and by roller guide means so that the inking rollers can supply the types with two colors or kinds of ink.

After the inking, when the hand lever 3 is squeezed further, the pressure applying assembly 20, carried along by the hand lever 3, moves its cam surfaces 21*a* into abutment contact with the pressure receiving rollers 28 of the pressure receiving assembly 26. Further squeezing of the hand lever 3 lifts and turns the pressure receiving cams 27 of the pressure receiving assembly 26 counter-clockwise about the cam shaft 32 against the biasing force of the torsion spring 33 so that the pressure applying surface 27*b* formed on the top of the pressure receiving cams 27 is brought into abutment contact with the stationary pressure receiving surface 2*b* of the grip levers 2. By this time, the contact surfaces 21*b* of the pressure cams 21 of the pressure applying assembly 20 are abutting against the pressure receiving surface 3*a* of the hand lever 3 and are applying the maximum pressure which must be overcome to accomplish the printing.

When a greater squeezing force is applied to the hand lever 3, the cam surfaces 21*a* of the pressure cams 21 are forced against the pressure receiving rollers 28 until the resilient cams 21 are idented, which establishes a strain or stores compression energy. When the cam surfaces 21*a* of the cams 21 are adequately compressed or when the pressure receiving rollers 28 are enabled to ride over the cam surfaces 21*a* due to the resiliency of the surfaces 21*a*, the printing heads 40*a* and 40*b* are released from their retention by the contact between the pressure cams 21 and pressure receiving rollers 28. Of course, it could be the rollers 28 that are resiliently deformable and that are compressed and deformed, instead of the cam surfaces 21*a*, or even both of the rollers 28 and the surfaces could be deformable. Once the overriding occurs, as shown in double-dotted lines in FIG. 2, the types 41*a* and 41*b* are freed to move into abutment contact with the label then on the platen 9, thus effecting label printing.

After the printing operation, when the hand lever 3 is released, the printing heads 40*a* and 40*b* can be returned to their initial, rest positions by the action of the return spring 7. During the return motion of the constant pressure printing mechanism A, the pressure receiving assembly 26 is biased clockwise under the influence of the torsion spring 33 so that the pressure cams 21 of the pressure applying assembly 20 are kept in contact with the pressure receiving rollers 28. However, the pressure applying assembly 20 is able to pass the rollers 28, by shifting slightly counter-clockwise so that the assembly 20 is allowed to restore to its initial rest position without any special resistance by the biasing force of the torsion spring 25.

As will be apparent from the foregoing description, with minimal modification to their configurations, the positions of the pressure applying and pressure receiving assemblies could be exchanged so that the pressure applying assembly would be on the grips 2 and the pressure receiving assembly would be on the hand lever.

The resistance applying ride-over means or printing pressure regulating means, comprised of the pressure applying assembly and the pressure receiving assembly, provides a number of advantages:

If the hand lever is squeezed with excessively strong force, the excessively high printing pressure is damped by the interaction between the pressure applying assembly and the pressure receiving assembly until the pressure is reduced to a preset constant printing pressure. If the hand lever is squeezed too weakly, the low printing pressure is accumulated or awaited by the interaction between the assemblies until the squeezing force is increased to achieve the constant printing pressure. Thus, it is possible to accomplish label printing at a constant pressure at all times and accordingly to ensure that the imprints on the labels have no irregularity and are highly accurate.

Since the pressure cams of the pressure applying assembly are made of a resilient, synthetic resin, the constant pressure printing mechanism can be quite durable, and thereby assure that the proper printing pressure will be applied for a longer time than a conventional mechanism, that uses the elasticity of a spring, would permit.

As a result, the constant pressure printing mechanism according to the present invention can exhibit prominent effects, especially when it is applied to a P.O.S. (i.e., Point-of-Sales) system, in which the printed indicia are automatically read out by means of an optical character reader.

Figure 4:
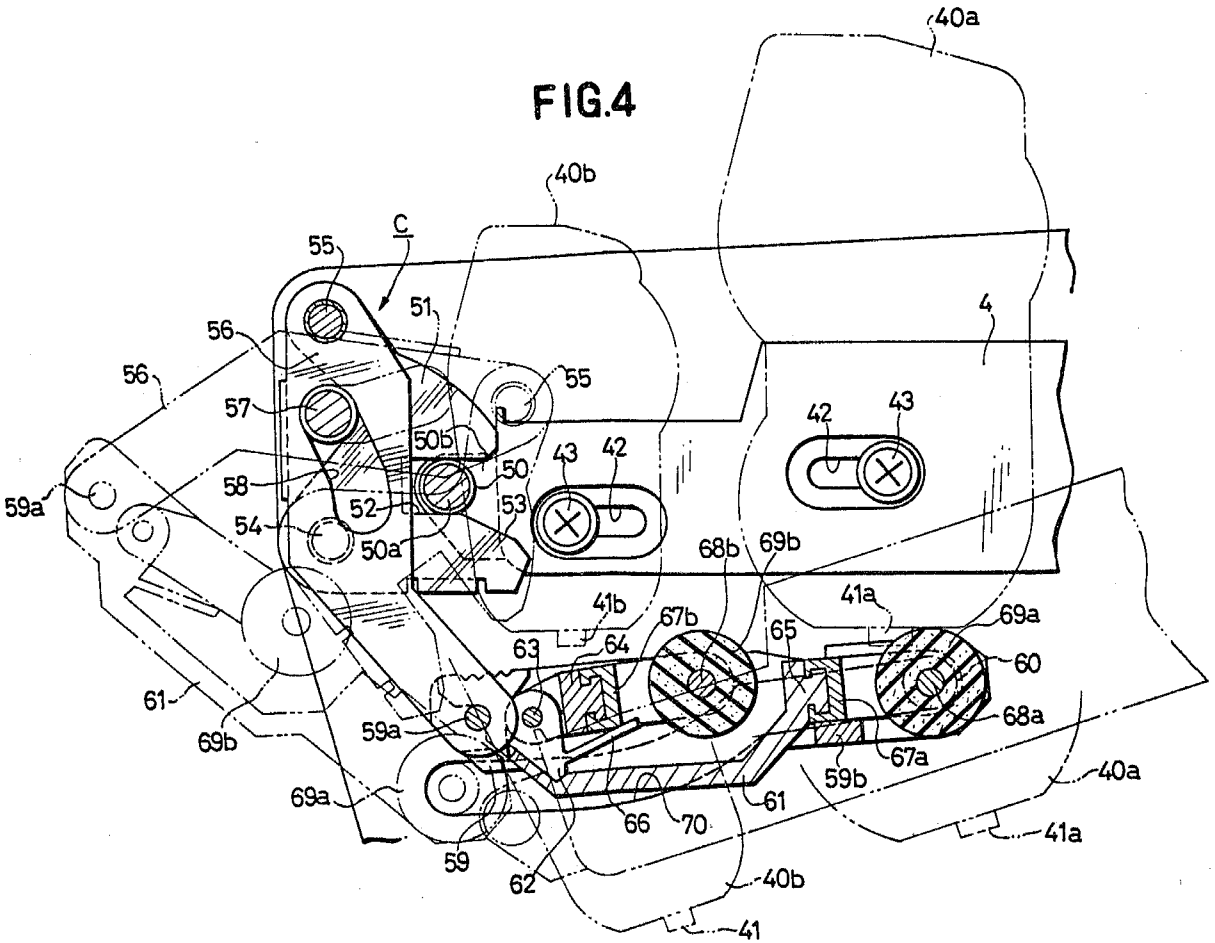
FIG. 4 is a longitudinal, partially sectional view of a fragment of FIG. 1, showing the ink supply mechanism of FIG. 1.

The ink supply mechanism C according to another feature of the present invention operates in connection with the motions of the printing levers 4. As best seen in FIG. 4, the ink supply mechanism C is comprised of a pair of starting rollers 50 that are carried on the leading ends of the printing levers 4, a pair of starting cams 51 that form a portion of a link mechanism, a pair of link frames 56, an inking roller holder 61 holding the inking rollers 69*a* and 69*b*, each for providing ink of a respective color, a holder frame 59 providing connection between inking roller holder 61 and the link mechanism, and roller guide means which are provided for at least one of the inking rollers 69*a* and 69*b* so that these rollers 69*a* and 69*b* can roll over their respective types 41*a* and 41*b*.

The pair of starting rollers 50 are rotatably mounted on the shaft 50*a* which is transversely supported in the supporting portions 50*b* extending from the leading ends of the printing levers 4. The paired cams 51 are engageable with the respective starting rollers 50. The cams 51 are attached to each other across the transverse direction of the hand labeler by means of a connecting member (not shown). The cams 51 include recesses 52, in which the starting rollers 50 are to be received. The recesses 52 include lower inclined surfaces 53, which are shaped to allow the starting rollers 50 to roll over them. The lower portions of the starting cams 51 are hingedly attached to the labeler frames 1 by means of a stationary pin 54. The upper portions of the cams 51 are hingedly attached to the link frames 56 by means of a movable pin 55. The paired link frames 56 have their upper portions pivotally connected to the movable pin 55 and their lower portions pivotally connected to the connecting pin 59*a* of the holder frame 59. The link frames 56 have a pair of curved slots 58 located intermediate their length and within which a stationary pin 57 fixed to the labeler frames 1 is received.

The inking roller holder 61 is made of a synthetic resin which is resilient and the holder 61 is supported by means of the connecting pin 59*a* of the holder frame 59 and by a connecting plate 59*b*. The holder 61 carries an inking roller engaging member 64 which is fixed to the supporting portion 62 of the holder 61 by a pin 63. The inking roller supporting member 67*b* of the second inking roller 69*b* is removably mounted on the engaging member 64. The secondary inking roller 69*b* is rotatably mounted on an inking roller shaft 68*b* which is mounted in the supporting member 67*b*. The elastic, resilient receiving member 66 comprises a spring of a synthetic resin which can provide a roller squeezing pressure of constant level when the inking roller 69*b* contacts the corresponding types 41*b*. The elastic receiving member 66 extends from the supporting portion 62 of the holder 61 and its free end abuts against the bottom of the inking roller supporting member 67*b*.

At the trailing (right hand) end of the inking roller holder 61, an inking roller engaging member 65 is formed. The inking roller supporting member 67*a* of the primary inking roller 69*a* is removably engaged with the member 65. The inking roller 69*a* is also made rotatable on its shaft 68*a*, which is mounted transversely in the supporting member 67*a* thereof.

The guide means for the first inking roller 69*a* includes a pair of engagement collars 60 mounted on both sides of the holder frame 59 and includes a pair of guide grooves 70 formed in the inner walls of the juxtaposed labeler frames 1. The guide grooves 70 are sized and shaped so that the primary inking roller 69*a* only rolls on the types 41*a* of the first printing head 40*a* thereby to ink these types but the roller 69*a* thereafter is moved downward to prevent it from contacting the types 41*b* of the second printing head 40*b*. There are no guide grooves for the second inking roller 69*b*, as the receiving member 66 urges it into position.

The inking rollers 69a and 69b are preferably inked such that the first roller 69a has a black color whereas the second roller 69b has a red color. The inking rollers 69a and 69b may alternatively have the inverse dichroic arrangement. Moreover, they may both be inked with one black color or with two other colors, if desired, etc.

The operation of the ink supply mechanism C is now described in the following with reference to FIGS. 1 and 4. When the hand lever 3 is squeezed toward the grip levers 2, the printing levers 4 carrying the printing heads 40a and 40b of the printing device B are turned downwardly, i.e., counter-clockwise, about the pivot pin 8. As the printing levers 4 are moved down, the starting rollers 50 at the leading (left hand) end of the printing levers are carried to turn the starting cams 51 clockwise about the stationary pin 54. As a result, the link frames 56 which are hinged to the starting cams 51 by means of the movable pin 55 are turned clockwise about the stationary pin 57 so that the holder frame 59 and the inking roller holder 61 are carried by the link frames 56 to the front of the body of the hand labeler.

The first inking roller 69a has its engagement collars 60 guided forward by the guide grooves 70, and the second inking roller 69b is carried forward while being supported by the elastic receiving member 66. Initially, the first inking roller 69a rolls on the types 41a of the first printing head 40a and thereby applies its black ink to the types 41a. After that, the first inking roller 69a is guided below or apart from the types 41b of the second inking roller 40b. Meanwhile, the second inking roller 69b is biased upwardly by the elastic receiving member 66 to roll over the types 41b of the second printing head 40b and thereby applies its red ink to the types 41b.

When the hand lever 3 is squeezed further, the engagement collars 60 of the first inking roller 69a are abruptly dropped at the curved portions of the guide grooves 70 so that the inking roller 69a can pass around the second types 41b.

When the starting rollers 50 are moved further downward as the lever squeezing proceeds, the rollers 50 are positioned on the inclined surfaces 53 of the starting cams 51, and this pressure engagement of the rollers 50 on the surfaces 53 causes the link frames 56 to have their curved slots 58 moved to the right or rearwardly along the stationary pin 57 until they assume their fallen positions, as shown in double-dotted lines in FIG. 4. As this motion proceeds, the holder frame 59 and the inking roller holder 61 assume their obliquely raised positions. As a result, the linear protrusion of the inking roller holder 61 to the front of the labeler body can be avoided to ensure excellent front view.

Immediately after the above described movement of the ink supply mechanism C, the constant pressure printing mechanism A is operated to abruptly bring the respective printing heads 40a and 40b into abutment contact with the platen 9 so that the label strip L can be imprinted under a preset constant pressure.

The return operation of the ink supply mechanism C is initiated by releasing the grip levers 2 and the hand lever 3. In response to the returning motion of the printing levers 4, the starting rollers 50 raise the starting cams 51 in the counter-clockwise direction so that the ink supply mechanism C is restored to its initial rest position. Since the starting rollers 50 are held during the printing operation in contact with the recesses 52 of the starting cams 51, the inking roller holder 61 which carries the inking rollers 69a and 69b is also returned in accordance with the movement of the starting rollers 50.

The ink supply mechanism of the present invention can also produce a number of advantages:

Since the starting means, that starts the inking motion of the inking rollers of the ink supply mechanism, includes starting rollers carried at the leading ends of the printing levers and that are held to engage with the recesses of starting cams which are coactive with the link frames and the inking roller holder, the starting means may be free from any slippage or lost motion during the starting operation.

The two inking rollers impregnated with ink of different colors are arranged and guided such that the first roller, which is positioned at the trailing side, is guided or regulated by guide grooves formed in the labeler frames, whereas the second roller, which is positioned at the leading side, is set free from the regulations of the guide grooves to follow a different locus. As a result, the inking rollers can ensure their respective inking operations in an accurate manner while only inking their corresponding types.

In the moving means for the inking rollers, since the starting cams and the link frames are connected by means of the movable pin and since the link frames themselves are formed with curved slots, the whole ink supply mechanism can be prevented from linearly protruding to the front of the labeler body, and can instead assume a retracted position. As a result, a wide field of view in front of the labeler body is assured during the label applying operation so that the label applying can be accomplished with clear observation of the label being applied.

Although the foregoing description has been directed to the embodiments in which the constant pressure printing mechanism and the ink supply mechanism are applied to a hand labeler, it should be understood that the present invention can be extended to modifications, in which the both mechanisms are used with a similar printing mechanism such as a hand operated tagging machine or a desk type automatic label printing machine.

Although the present invention has been described in connection with the preferred embodiments thereof, many variations and modifications will now become apparent to those skilled in the art. It is preferred, therefore, that the present invention be limited not by the specific disclosure herein, but only by the appended claims.

What is claimed is:

1. A label printing machine, comprising:

a machine frame;

an operating lever, for being operated to move with respect to the machine frame; a printing lever integrally connected with said operating lever such that said operating lever and said printing lever move together from a rest position toward a printing position; a first pivot connection between said operating and printing lever, on the one hand, and said machine frame, on the other hand, and being located intermediate the length of said operating and printing lever; a printing device, including printing types, carried on said printing lever;

a platen connected to said machine frame and positioned in opposition to said types as said printing lever moves to said printing position, whereby said types will engage a label on said platen when said printing lever is in said printing position;

printing pressure regulating means interposed between said operating lever and said machine frame, said printing pressure regulating means comprising:

a pressure applying cam pivotally supported at a second pivot connection on one of said operating lever and said machine frame and in the vicinity of said first pivot connection; said cam having a cam surface thereon spaced from the said second pivot connection;

a pressure receiving roller and a support for said roller, said support being pivotally attached at a third pivot connection to the other of said operating lever and said frame;

respective means for positioning said roller support and said cam such that said cam surface will abut said roller as said operating lever moves toward said printing position and before said type engage said platen, said third pivot connection being spaced from the location on said roller to be abutted by said cam surface, whereby pivoting of said support moves said abuttable location of said roller on an arcuate pathway;

first biasing means for urging said cam to pivot to a position for blocking bypassage of said cam surface and said roller; second biasing means for urging said roller support to move said roller location to a position for blocking bypassage of said cam surface and said roller; said first and said second biasing means being of such relative strengths that when said cam surface has been moved into abutment with said roller and when a predetermined pressure is applied on said operating lever, at least one of said cam and said roller support resiliently deflects and pivots to permit said cam surface to bypass said roller, so that said types are then freed to abut a label on said platen due to force being applied to said operating lever to move said printing lever to said printing position.

2. The label printing machine of claim 1, wherein said second pivot connection is on said operating lever and said third pivot connection is on said machine frame.

* * * * *